United States Patent [19]

Ford

[11] 3,990,258

[45] Nov. 9, 1976

[54] LAUNCHING MEANS FOR SURFACE EFFECT SHIPS

[75] Inventor: Allen G. Ford, Rockville, Md.

[73] Assignee: The United States of America as represented by the Secretary of the Navy, Washington, D.C.

[22] Filed: Dec. 5, 1974

[21] Appl. No.: 529,992

[52] U.S. Cl. ..... 61/67; 180/116

[51] Int. Cl.[2] ..... B63C 3/00

[58] Field of Search ..... 61/67, 65; 114/43.5, 114/66, 1 A, 44, 67 R; 180/116

[56] References Cited

UNITED STATES PATENTS

| | | | |
|---|---|---|---|
| 2,542,847 | 2/1951 | Turnbull | 61/67 X |
| 2,564,951 | 8/1951 | Blagden | 61/67 |
| 3,587,874 | 6/1971 | Graf | 61/67 X |
| 3,768,429 | 10/1973 | Greer | 61/67 X |

FOREIGN PATENTS OR APPLICATIONS

| | | | |
|---|---|---|---|
| 1,234,939 | 6/1971 | United Kingdom | 180/116 |
| 1,203,417 | 8/1970 | United Kingdom | 180/116 |

*Primary Examiner*—Dennis L. Taylor
*Attorney, Agent, or Firm*—R. S. Sciascia; Q. E. Hodges

[57] ABSTRACT

A launching and recovering means for surface effect ships comprising an elevated ramp which extends into the water, and which is designed to be straddled by the surface effect ship. The width of the ramp matches the inside width of the contained pressure section plenum chamber of the surface effect ship; hydraulic jacks or other extensible members support the surface effect ship at the upper end of the ramp.

1 Claim, 5 Drawing Figures

LAUNCHING MEANS FOR SURFACE EFFECT SHIPS

The invention described herein may be manufactured and used by or for the Government of the United States of America for governmental purposes without the payment of any royalties thereon or therefor.

BACKGROUND

Surface effect ships (SES), as is well known, comprise a superstructure which is supported on a cushion of air that is contained by rigid sidewalls and flexible seals fore and aft sometimes called a plenum chamber. As long as the fan is on and the Cushion of air is maintained, the SES will remain in its proper attitude with respect to the water's surface. When the fan is turned off, however, there is insufficient buoyancy in the sidewalls and fore and aft seals to maintain the SES in its former attitude; the craft will thus sink to a fairly low point in the water.

Obviously, the fan could be left running at all times to maintain the craft in its proper position on the water's surface. However, this would consume large amounts of fuel if the craft were to be docked for any great length of time. Therefore standard practice is to have all docking and loading facilities for an SES or air cushion vehicle on land, so that the craft is in the water only when its fan is on and providing the cushion of supporting air. The docking means for a craft whose cushion of air is contained within a flexible skirt is generally a flat surface which can withstand the weight of the craft. The craft is driven onto this flat surface, and the fan is turned off. As air cushion pressure decreases, the craft gradually settles down onto the flat surface until its weight is supported by the rigid structure of the craft.

This type of facility cannot be used with an SES for the following reasons. First, the sidewalls of an SES are not designed to withstand the weight of the entire vehicle; it would be possible to design the sidewalls for this task, but this would then decrease the cargo carrying capacity of the SES. Second, the sidewalls of an SES extend below the level of the fore and aft seals; when the craft is in the water, the lower parts of the sidewalls are below the water's surface and the fore and aft seals are right at the water's surface. If an attempt is made to drive an SES onto a flat ramp that extends out of the water, a large gap will form between the fore seal and the surface of the ramp. Ultimately, this gap will become large enough to allow all of the air in the air cushion to escape; at this point the SES will be grounded at a point that is midway between being fully in the water and fully out of the water.

SUMMARY

Briefly, the present invention is a launching and recovering means for an SES which comprises an elevated ramp which extends into the water. The width of the ramp is approximately the same as the width of the contained pressure section plenum chamber of the SES; the height of the ramp is sufficient to allow the bottom of the sidewalls to clear the ground when the SES is on the ramp. The SES straddles the ramp, with its fan running so that it is supported on its cushion of air, and is pulled up the ramp by a winch or other means. At the top of the ramp hydraulic jacks or other extensible members are raised until they contact the bottom surface of the contained pressure section. The fan is then turned off, and the SES rests on the jacks.

OBJECT OF THE INVENTION

Accordingly, it is an object of the present invention to provide a launching and recovering means for an SES.

It is a further object of the present invention to provide a launching and recovering means for an SES wherein the SES is supported on its air cushion during travel on the launch and recovering means.

It is a further object of the present invention to provide a launch and recovering means for an SES having static support means for the SES at the top of the launch and recovery means.

Other objects and advantages of the present invention will be apparent from the following specification and accompanying drawings.

DESCRIPTION OF THE PREFERRED EMBODIMENT

Figure 1:
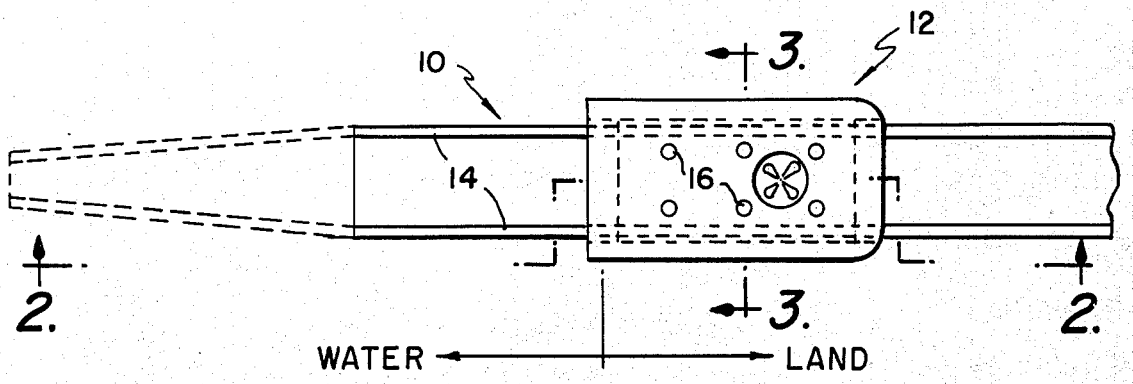
FIG. 1 is a top view of a launch and recovering means according to the present invention.
Figure 2:
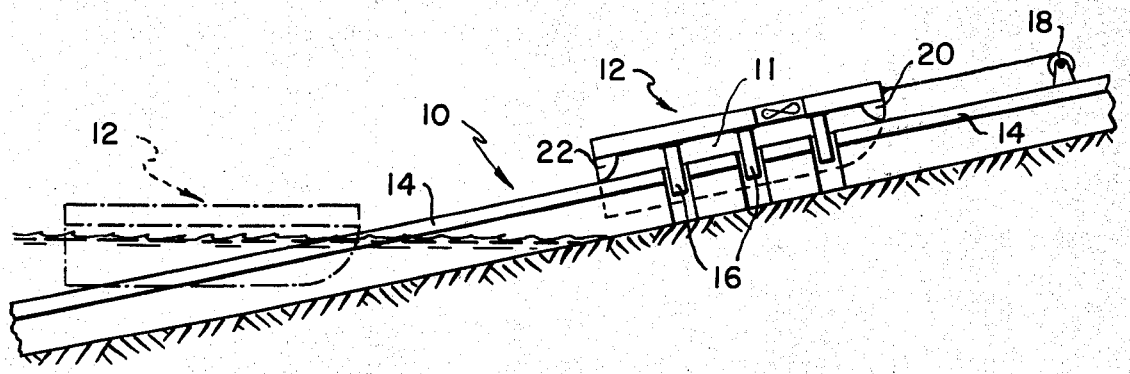
FIG. 2 is taken on line 2—2 of FIG. 1.
Figure 3:
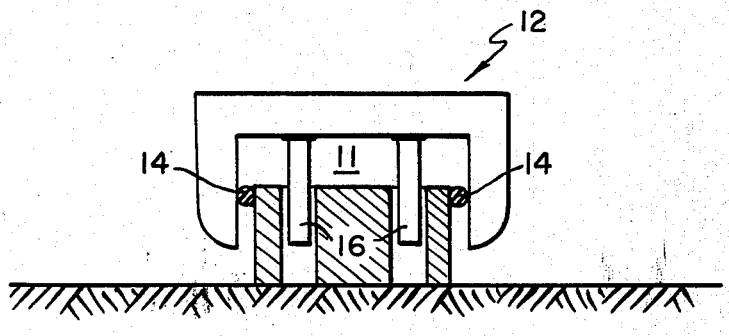
FIG. 3 is taken on line 3—3 of FIG. 1.

FIGS. 1, 2, and 3 show an inclined ramp 10 which is used for launching and recovering a surface effect ship (SES). Ramp 10 is inclined, with its lower end extending into and beneath the water's surface as shown. The upper end of ramp 10 is of a constant width, which is only slightly narrower than the width of the inside of the contained pressure section 11 as shown in FIG. 3. The lower end of the ramp is tapered; the degree of taper is not critical, since its only function is to guide the SES onto the constant width part of the ramp. However, the tapered part of ramp 10 should always be below the water's surface as will be explained later. The edges of ramp 10 have bumpers 14 on them to protect the SES when it is straddling the ramp; these bumpers 14 may be inflated bags, foam rubber, or any other material commonly used as a bumper material. The minimum height ramp 10 is that which will allow an SES to straddle the ramp while keeping its sidewalls above the ground. Thus the height of the ramp and its width are functions of the size of the SES which the ramp is designed to accomodate.

At the upper end of ramp 10 is a series of hydraulic jacks or other extensible members 16. These jacks support the weight of the SES when it is stopped in the docking position.

At the top of ramp 10 is a winch or other device 18 which is used for pulling the SES up the ramp.

Ramp 10 can be made of any material which will support the weight of the SES and is compatible with a marine environment. Obviously a preferred material for this type of construction is reinforced concrete; however, any other material which is suitable can be used.

Operation of the ramp for recovering an SES is as follows. The SES approaches the ramp as shown in dashed lines in FIG. 2. When the fore seal is approximately in contact with the surface of the ramp, as shown in FIG. 2, a line is passed from winch 18 to the SES. The SES is then hauled up the ramp by means of winch 18. As stated earlier, the tapered section of ramp 10 must always be below the water's surface. The reason is that there must always be a continuous surface beneath the contained pressure section or plenum chamber of the SES to keep the air cushion within the contained pressure section. If the tapered section were out of the water, and the SES were to be pulled up this tapered section while it was exposed, all of the air in the contained pressure section would leak out between the sidewalls and the tapered section of the platform, thus grounding the SES on the ramp.

The SES is pulled up the ramp with its fan still running; when it reaches the part of the ramp which contains jacks 16, winch 18 is stopped and the SES is held at that point. Jacks 16 are then raised until they contact the bottom surface of the contained pressure section or plenum chamber of the SES and the jacks then receive the full weight of the SES. At this point the fan is turned off, and the SES now rests on jacks 16. Thus none of the weight of the SES is ever carried by the sidewalls or the fore and aft seals 20 and 22 respectively.

Launching is the reverse of recovering. The fan is turned on, the jacks are retracted, and then the SES is lowered down the ramp by means of winch 18.

The ramp can be designed to accommodate more than one size of SES by making the surface of the ramp horizontally extensible across its width; this could be accomplished by inflatable means of inflatable bumpers 14 for example. Thus the width of the ramp can be varied to accommodate the width of the contained pressure section of more than one SES. The vertical height of the ramp does not need to be varied if the size of the SES varies; all that is necessary is that the ramp be high enough to accommodate the largest SES that would use the ramp.

Figure 4:
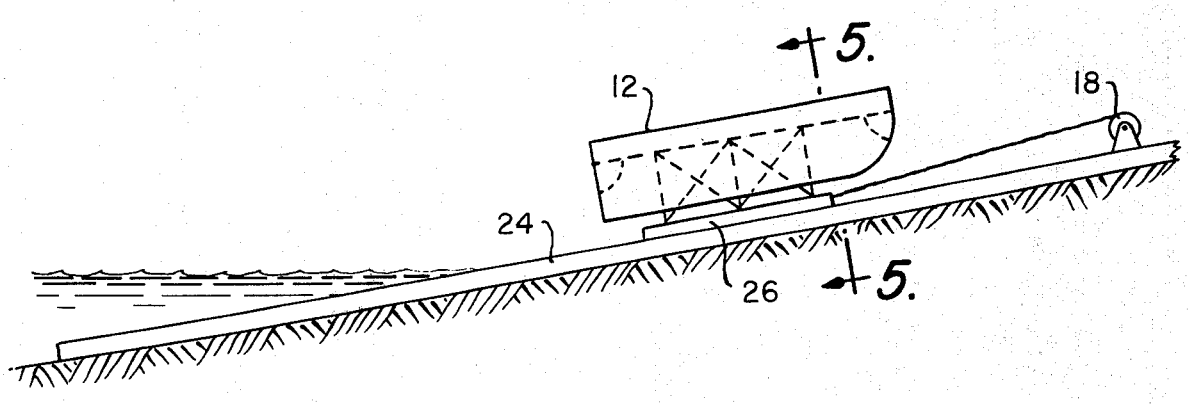
FIG. 4 shows an alternate means of launching and recovering an SES.
Figure 5:
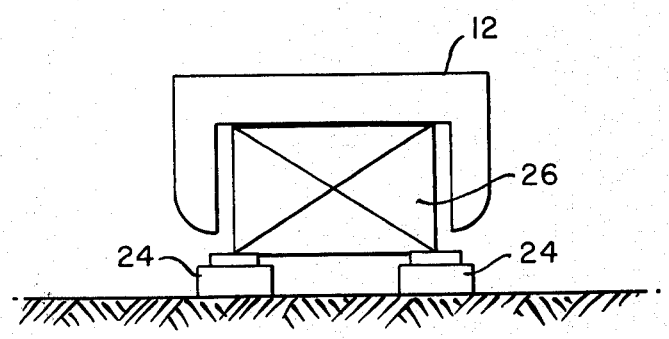
FIG. 5 is taken on line 5—5 of FIG. 4.

FIGS. 4 and 5 show another embodiment of a launching means for an SES. This embodiment comprises an inclined ramp 24 which extends into the body of water as shown. Resting on ramp 24 is a cart or carriage 26, which fits within the contained pressure section of SES 12 and is heavier than water.

Operation of this embodiment is as follows. Cart 26 is lowered to the end of ramp 24 by means of winch 18. Ramp 24 extends a sufficient distance into the water to allow cart 26 to fit under the SES when it is above the end of the ramp. When the SES is above the cart, its fan is turned off and the SES settles onto the cart. The cart is then pulled up ramp 24 by means of winch 18.

Launching is the reverse of recovering. The cart is lowered down the ramp until it is in water deep enough for operation of the SES, the fan is turned on, and the SES then proceeds under its own power.

Obviously many modifications and variations of the present invention are possible in light of the above teachings. It is therefore to be understood that within the scope of the appended claims the invention may be practiced otherwise than as specifically described.

What is claimed is:

1. A launching and recovery means for a surface effect ship comprising:

an inclined ramp extending into a body water, said ramp being supported a distance above the ground sufficient to support the ship clear of the ground;

a movable carriage mounted for movement along said ramp, said carriage extending above the ramp and into the plenum chamber of the ship to support the ship above the ramp, said carriage substantially filling said plenum chamber whereby the weight support of said ship is distributed over substantially the whole of the interior of the plenum chamber by said carriage;

means attached to said carriage for moving said carriage on said ramp.

* * * * *